United States Patent [19]

Aoki et al.

[11] Patent Number: 4,590,141

[45] Date of Patent: May 20, 1986

[54] CARRIER PARTICLES FOR USE IN A TWO-COMPONENT DRY-TYPE DEVELOPER FOR DEVELOPING LATENT ELECTROSTATIC IMAGES

[75] Inventors: Mitsuo Aoki, Numazu; Satoru Inoue, Mishima; Kimitoshi Yamaguchi, Numazu; Mitsuru Uchida, Susono; Masami Tomita, Numazu; Chiaki Uematsu, Fuji, all of Japan

[73] Assignee: Ricoh Company, Tokyo, Japan

[21] Appl. No.: 662,796

[22] Filed: Oct. 19, 1984

Related U.S. Application Data

[63] Continuation-in-part of Ser. No. 479,406, Mar. 28, 1983, abandoned.

[30] Foreign Application Priority Data

Apr. 8, 1982 [JP] Japan ..... 57-57313
May 28, 1982 [JP] Japan ..... 57-89877

[51] Int. Cl.[4] ..... G03G 9/10
[52] U.S. Cl. ..... 430/108; 430/110
[58] Field of Search ..... 430/137, 110, 108

[56] References Cited

U.S. PATENT DOCUMENTS 4,245,022 1/1981 Sadamatsu et al. ..... 430/110

FOREIGN PATENT DOCUMENTS 46820 4/1977 Japan ..... 430/110
0191650 11/1982 Japan ..... 430/108

*Primary Examiner*—John L. Goodrow
*Attorney, Agent, or Firm*—Flynn, Thiel, Boutell & Tanis

[57] ABSTRACT

Carrier particles are disclosed for use in a two-component dry-type developer for developing latent electrostatic images to visible images, for use in electrophotography, electrostatic recording methods and electrostatic printing methods, which carrier particles are coated with a silicone resin coating layer having high resistance to abrasion and the so-called "spent phenomenon" while in use, and which therefore can be used repeatedly for a long period of time, yielding developed images with high quality. The high resistance to abrasion of the silicone resin coating layer is attained by adding to the silicone coating layer, as an inorganic fortifying agent against abrasion, silicon carbide or potassium titanate.

13 Claims, 4 Drawing Figures

CARRIER PARTICLES FOR USE IN A TWO-COMPONENT DRY-TYPE DEVELOPER FOR DEVELOPING LATENT ELECTROSTATIC IMAGES

This application is a continuation-in-part of U.S. Ser. No. 479 406, filed Mar. 28, 1983 now abandoned.

BACKGROUND OF THE INVENTION

The present invention relates to carrier particles for use in a two-component dry-type developer for developing latent electrostatic images to visible images, for use in electrophotography, electrostatic recording methods and electrostatic printing methods, and more particularly to carrier particles coated with a silicone layer containing, as an inorganic fortifying agent against abrasion, silicone carbide or potassium titanate.

Conventionally, as a developer for use in these fields, the so-called two-component dry-type developer is known, which comprises carrier particles and toner particles. In the two-component dry-type developer, the particle size of the toner particles is very much smaller than the particle size of the carrier particles, and the toner particles are triboelectrically attracted to the carrier particles and are held on the surface of the carrier particles. That electric attraction between the toner particles and the carrier particles is caused by the friction between the toner particles and the carrier particles. When the toner particles held on the carrier particles are brought near or into contact with a latent electrostatic image, the electric field of the latent electrostatic image works on the toner particles to separate the toner particles from the carrier particles, overcoming the bonding of the toner particles to the carrier particles, with the result that the toner particles are attracted towards the latent electrostatic image and the latent electrostatic image is thus developed to a visible image. In the case of the two-component dry-type developer, only the toner particles are consumed as the development is performed. Therefore, it is necessary to replenish the toner particles in the course of repeated development by the apparatus.

Further, it is necessary to triboelectrically charge the toner particles to the desired polarity and with a sufficient amount of charges, and to maintain the amount of the charges and the polarity for a long period of time during use. In the case of a conventional two-component type developer, it is apt to occur that the resin contained in and released from the toner particles in the course of the mechanical mixing of the toner particles and the carrier particles in the development apparatus eventually covers the surface of the carrier particles. Once the surface of the carrier particles is covered with the resin, which is generally referred to as the "spent phenomenon," such carrier particles no longer function as active carrier particles, that is, carrier particles which contribute to development. As a result, the charging characteristics of the carrier particles in the conventional two-component type developer deteriorate with time while in use. In the end, it is necessary to replace the entire developer by new developer.

In order to prevent the spent phenomenon, a method of coating the surface of carrier particles with a variety of resins has been proposed. However, resins which can in fact prevent the spent phenomenon have not been discovered. At one extreme, for instance, carrier particles coated with a styrene methacrylate copolymer or polystyrene are excellent in their triboelectric charging properties. However, since the surface energy of the carrier particles is comparatively high, the carrier particles are easily covered with the resin contained in the toner particles while in use. As a result, the spent phenomenon occurs easily and, accordingly, the life of such developer is short.

As carrier particles coated with a coating layer with a low surface energy, for example, the following carrier particles which are coated with a layer containing a silicone resin having a low surface energy have been proposed:

- Carrier particles coated with a coating layer in which an unsaturated silicone resin, an organosilicon, silanol and other resins are mixed with a styrene-acrylic resin, as disclosed in U.S. Pat. No. 3,562,533;
- Carrier particles coated with a coating layer comprising a polyphenylene resin and an organosilicon-containing terpolymer resin, as disclosed in U.S. Pat. No. 3,847,127;
- Carrier particles coated with a coating layer comprising a styrene-acrylate-methacrylate resin, organosilane, silanol, siloxane and other resins, as disclosed in U.S. Pat. No. 3,627,522;
- Carrier particles coated with a coating layer comprising a silicone resin and a nitrogen-containing resin having positive charging characteristics, as disclosed in Japanese Laid-Open Patent Application No. 55-127567; and
- Carrier particles coated with a coating layer comprising an acrylic-resin-modified silicone resin, as disclosed in Japanese Laid-Open Patent Application No. 55-157751.

However, the silicone resins employed above are relatively weak in terms of mechanical strength. Therefore, if the carrier particles coated with such silicone resins are used with vigorous mixing, for example, in a development apparatus of a high speed copy machine, the coated layer is scratched or scraped off by collisions with the other carrier particles, the inner wall of the development apparatus and the surface of a photoconductor installed in the development apparatus. Eventually, the coated layer is removed from the carrier particles. As a result, the triboelectric charging of the developer occurs, not between toner particles and the silicone resin layer of the carrier particles, but between toner particles and the core material of the carrier particles. This change in the charging mode changes the quantity of electric charges of the developer and the image quality deteriorates.

In order to eliminate that shortcoming of the above silicone resins, methods of adding a variety of additives to fortify the silicone resins against abrasion have been proposed.

However, no additives which are capable of satisfactorily fortifying the silicone resins against abrasion, without changing the triboelectric charging performance of the carrier particles in respect of the toner particles, have been proposed.

SUMMARY OF THE INVENTION

It is therefore an object of the present invention to provide carrier particles for use in a two-component dry-type developer for developing latent electrostatic images to visible images, for use in electrophotography, electrostatic recording methods and electrostatic printing methods, which carrier particles are coated with a silicone resin coating layer having high resistance to abrasion and not contributing substantially to the "spent phenomenon" while in use, and which therefore can be used repeatedly for a long period of time, and are capable of yielding developed images with high quality.

This object of the present invention is attained by carrier particles which are coated with a coating layer comprising a silicone resin and an inorganic fortifying filler, that is, silicon carbide or potassium titanate.

DETAILED DESCRIPTION OF THE PREFERRED EMBODIMENTS

Figure 1:
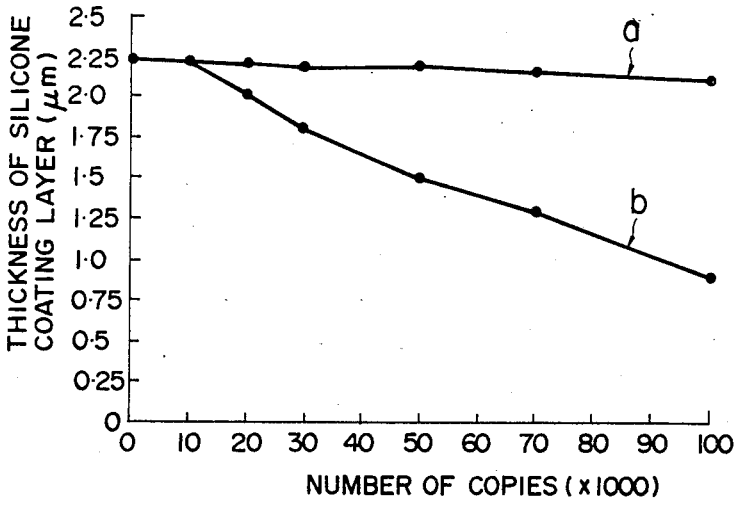
FIG. 1 is a graph showing the change in thickness of a silicone resin layer in an embodiment No. 1 of carrier particles according to the present invention as well as the change in thickness of a silicone resin layer coated on the surface of comparative carrier particles No. 1, during 100,000-copy tests by use of developers containing the respective carrier particles.

Carrier particles according to the present invention are coated with a silicone resin layer containing an inorganic fortifying filler, that is, silicon carbide or potassium titanate.

As a silicone resin for use in the silicone resin layer of the carrier particles, any of the conventional silicone resins can be used. In particular, a room-temperature-setting-type silicone resin of the following general formula is preferable for use in the present invention:

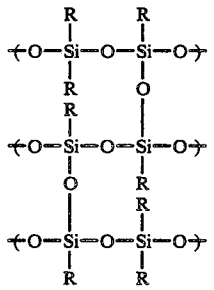

wherein R represents hydrogen, halogen, a hydroxy group, a methoxy group, a lower alkyl group with 1 to 4 carbon atoms, or a phenyl group.

The following commercially available silicone resins can also be employed in the present invention: Silicone resins KR 271, KR 255, KR 250 and KR 152 made by The Shin-Etsu Chemical Co., Ltd.; and silicone resins SR 2400, SH 840 and SR 2406 made by Toray Silicone Co., Ltd.

As the core material of the carrier particles which are coated with the above-described silicone resin, metallic or non-metallic particles with an average particle size ranging from 20 μm to 1000 μm, preferably ranging from 50 μm to 500 μm, such as particles of sand, cobalt, iron, iron oxide, copper, nickel, zinc, aluminum, brass or glass, can be employed.

The silicone resins can be coated on the core material by conventional procedures, for instance, by dissolving the silicone resin in an organic solvent and spraying the core material with the resin solution.

In using silicon carbide or potassium titanate as the fortifying agent for the silicone coating layer, the silicone resin is first dissolved in a solvent, silicone carbide or potassium titanate is then added to the solution, and that mixture is dispersed in a mixer. The thus prepared dispersion is applied to the core material, so that carrier particles according to the present invention are prepared.

It is preferable that the average particle size of the silicon carbide or potassium titanate be in the range of 0.1 μm to 1.0 μm and the amount thereof relative to the total weight of the silicone layer be in the range of 5 wt.% to 50 wt.%.

Further, it is preferable that the above silicone coating layer be heated at temperatures ranging from 200° C. to 300° C. after coating in order that the amount of the unhardened silicone resin in the entire silicone resin be not more than 30 wt.%. This is because, by that heating, the strength of the coated silicone resin layer is increased as compared with the unheated silicone resin, so that scratches in and cracking of the layer and the spent phenomenon are significantly reduced, and the charge application properties of the carrier particles to the toner particles are very much stabilized.

When the room temperature setting-type silicone resin is not subjected to the above-described heat treatment at temperatures ranging from 200° C. to 300° C., the amount of the unhardened silicone resin in the entire silicone resin is about 50 wt.%.

The amount of the unhardened silicone resin in the silicone resin layer coated on the carrier particles can be easily determined, since the unhardened silicone resin is soluble in an organic solvent, such as toluene or xylene, and the amount of the dissolved silicone resin can be determined without difficulty. Thus, the ratio of the unhardened silicone resin to the entire silicone resin in the silicone resin layer coated on the carrier particles can be determined by comparing the absolute amount of the dissolved silicone resin with the absolute amount of the entire amount of the silicone resin in the coated layer.

Toner particles to be used in combination with the above carrier particles according to the present invention can be prepared by a conventional procedure, for example, by mixing resin components and a colorant necessary for forming visible images, such as carbon black, kneading the mixture by heat rollers, crushing the hardened lump into powder when cooled, and classifying the powder.

In particular, when toner particles are charged to a negative polarity by use of the carrier particles according to the present invention, it is preferable to use toner particles containing as a charge polarity control agent a monoazo metal complex dye of the following formula:

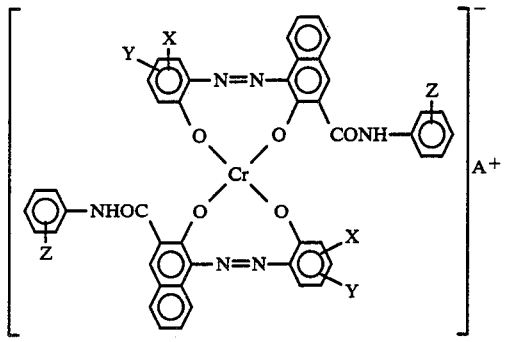

wherein X, Y and Z independently represent hydrogen, halogen, a carboxyl group, a hydroxyl group, a nitro group, a sulfo group or a sulfonamide group; and $A^+$ represents $H^+$, $K^+$, $Na^+$ or an aliphatic ammonium cation.

In case image fixing is performed by heat rollers, it is preferable that particles of a polymer with a low molecular weight, which has surface lubricating properties, such as a low-molecular-weight polypropylene or polyethylene, be deposited on or thermally adhered to the surface of the toner particles, in an amount of 0.2 wt.% to 2.0 wt.% with respect to the toner particles, in order that the toner particles be easily released from the heat rollers after image fixing.

It is preferable that the thus prepared toner particles be mixed with the carrier particles in such an amount as to cover 30% to 90% of the silicone coated surface of the carrier particles.

Referring to the following examples, embodiments of carrier particles according to the present invention will now be explained in detail.

EXAMPLE 1

The following components were dispersed in a homomixer for 30 minutes to prepare a silicone resin coating liquid:

| | Parts by Weight |
|---|---|
| Silicone Resin KR250 made by The Shin-Etsu Chemical Co., Ltd. (containing 20 wt. % of silicone resin solids) | 0.8 Kg |
| Ligroin | 1.2 Kg |
| Silicon carbide (with an average particle size of 0.23 μm) | 10 g |
| Toluene | 2 kg |

The thus prepared silicone resin coating liquid was coated on the surface of iron oxide particles with an average particle size of 100 μm in an amount of 5 kg, in a fluidized bed type coating apparatus. The iron oxide particles coated with the silicone resin were subjected to heat treatment at 250° C. for 2 hours, whereby silicone-resin-coated carrier particles No. 1 according to the present invention were obtained.

The following components were mixed, kneaded by heat rollers, crushed and classified under a conventional procedure, so that toner particles with an average particle size of 6 μm were prepared:

| | Parts by Weight |
|---|---|
| Polystyrene | 85 |
| Metal complex dye of formula (I) | 1 |
| Carbon black | 14 |

Formula (I)

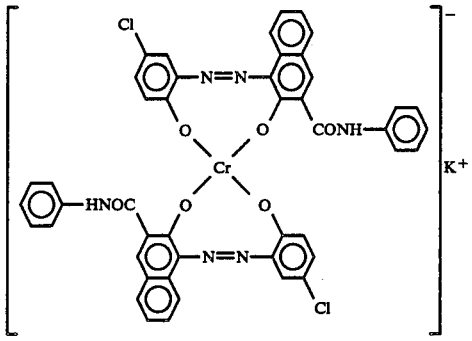

100 parts by weight of the carrier particles and 2.5 parts by weight of the above prepared toner particles were mixed to prepare a two-component dry-type developer. The thus prepared two-component dry-type developer was subjected to a copy test in which 100,000 copies were made, as the toner particles were replenished when necessary, by use of a commercially available copying machine, FT-6400, made by Ricoh Co., Ltd., in which positive latent electrostatic images were formed and developed by a magnetic brush development method.

During this copy test, clear copies were invariably obtained. Further, during this copy test, the thickness of the silicone resin layer of the carrier particles was measured periodically. The result is shown by curve a in FIG. 1, which indicates that the thickness of the silicone resin layer substantially did not vary throughout the copy test. Microscopic inspection of the carrier particles indicated that there were substantially no scratches in the silicone layer and no peeling of the silicone layer.

COMPARATIVE EXAMPLE 1

Example 1 was repeated except that silicon carbide was eliminated from the formulation of the silicone resin coating liquid and that the carrier particles coated with the silicone resin were not subject to the heat treatment conducted in Example 1, whereby comparative carrier particles were prepared. By use of the comparative carrier particles, a comparative developer No. 1 was prepared in the same manner as in Example 1. The comparative developer No. 1 was subjected to the same 100,000-copy test as in Example 1. The results were that the image quality decreased during the copy test and the thickness of the silicone layer of the comparative carrier particles decreased as shown by curve b in FIG. 1.

EXAMPLE 2

The following components were dispersed in a homomixer for 30 minutes to prepare a silicone resin coating liquid:

| | Parts by Weight |
|---|---|
| Silicone Resin SR2400 made by Toray Silicone Co., Ltd. (containing 20 wt. % of silicone resin solids) | 0.6 Kg |

-continued

| | Parts by Weight |
|---|---|
| Ligroin | 0.6 Kg |
| Silicon carbide (with an average particle size of 0.15 μm) | 10 g |
| Toluene | 1.2 kg |

The thus prepared silicone resin coating liquid was coated on the surface of iron oxide particles with an average particle size of 70 μm, in an amount of 5 kg, in a fluidized bed type coating apparatus, whereby silicone resin-coated carrier particles No. 2 according to the present invention were obtained.

100 parts by weight of the carrier particles and 3.0 parts by weight of the toner particles prepared in Example 1 were mixed to prepare a two-component dry-type developer. The thus prepared two-component dry-type developer was subjected to the same copy test as in Example 1, in which 100,000 copies were made, as the toner particles were replenished when necessary, by use of the same copying machine, FT-6400, as that employed in Example 1.

Figure 2:
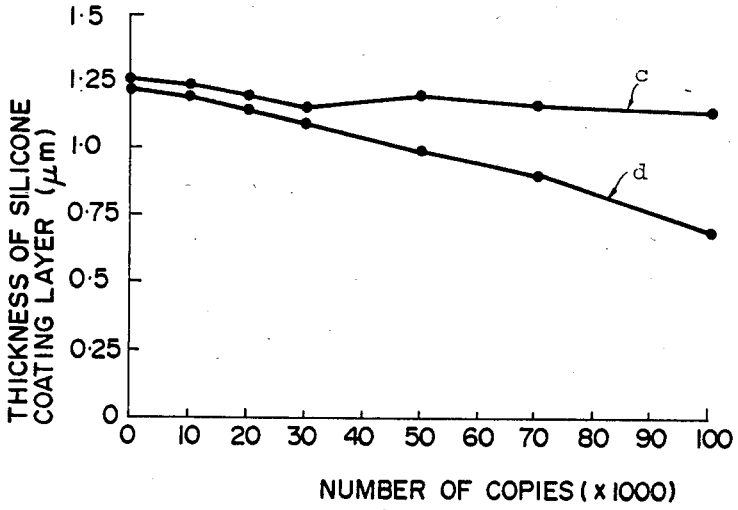
FIG. 2 is a graph showing the change in thickness of a silicone resin layer in an embodiment No. 2 of carrier particles according to the present invention and the change in thickness of a silicone resin layer coated on the surface of comparative carrier particles No. 2, during 100,000-copy tests by use of developers containing the respective carrier particles.

During this copy test, clear copies were invariably obtained. Further, during this copy test, the thickness of the silicone resin layer of the carrier particles was measured periodically, with the result that, as shown by curve c in FIG. 2, the thickness of the silicone resin layer substantially did not vary throughout the copy test.

Microscopic inspection of the carrier particles indicated that there were substantially no scratches in the silicone layer and no peeling of the silicone layer.

COMPARATIVE EXAMPLE 2

Example 2 was repeated except that silicon carbide was eliminated from the formulation of the silicone resin coating liquid, whereby comparative carrier particles were prepared. By use of the comparative carrier particles, a comparative developer No. 2 was prepared in the same manner as in Example 2. The comparative developer No. 2 was subjected to the same 100,000-copy test as in Example 1. The results were that the image quality decreased during the copy test and the thickness of the silicone layer of the comparative carrier particles decreased as shown by curve d in FIG. 2.

EXAMPLE 3

The following components were dispersed in a homomixer for 30 minutes to prepare a silicone resin coating liquid:

| | Parts by Weight |
|---|---|
| Silicone Resin KR250 made by The Shin-Etsu Chemical Co., Ltd. (containing 20 wt. % of silicone resin solids) | 0.4 Kg |
| Ligroin | 0.6 Kg |
| Potassium titanate (with an average particle size of 0.2 μm) | 5 g |
| Toluene | 1 kg |

The thus prepared silicone resin coating liquid was coated on the surface of iron oxide particles with an average particle size of 100 μm, in an amount of 5 kg, in a fluidized-bed-type coating apparatus, whereby silicone-resin-coated carrier particles No. 3 according to the present invention were obtained.

100 parts by weight of the carrier particles and 3.0 parts by weight of the toner particles prepared in Example 1 were mixed to prepare a two-component dry-type developer. The thus prepared two-component dry-type developer was subjected to the same copy test as in Example 1, in which 100,000 copies were made, as the toner particles were replenished when necessary, by use of the same copying machine, FT-6400, as that employed in Example 1.

Figure 3:
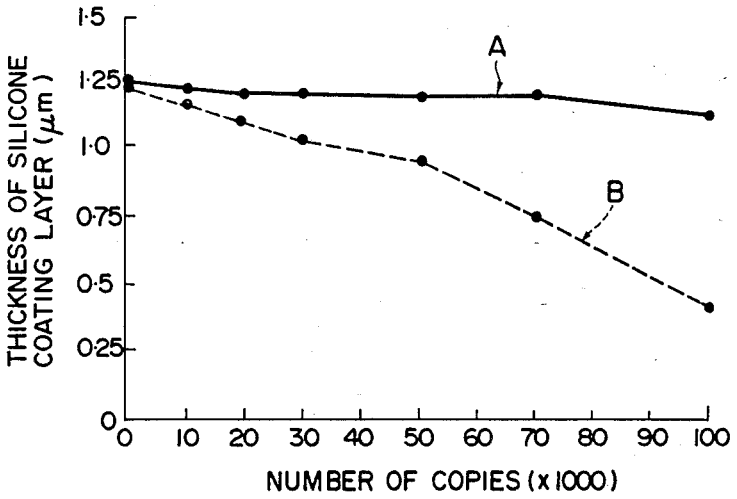
FIG. 3 is a graph showing the change in thickness of a silicone resin layer in an embodiment No. 3 of carrier particles according to the present invention and the change in thickness of a silicone resin layer coated on the surface of comparative carrier particles No. 3, during 100,000-copy tests by use of developers containing the respective carrier particles.

During this copy test, clear copies were invariably obtained. Further, during this copy test, the thickness of the silicone resin layer of the carrier particles was periodically measured, with the result that, as shown by curve A in FIG. 3, the thickness of the silicone resin layer substantially did not vary throughout the copy test.

Microscopic inspection of the carrier particles indicated that there were substantially no scratches in the silicone layer and no peeling of the silicone layer.

COMPARATIVE EXAMPLE 3

Example 3 was repeated except that potassium titanate was eliminated from the formulation of the silicone resin coating liquid, whereby comparative carrier particles were prepared. By use of the comparative carrier particles, a comparative developer No. 3 was prepared in the same manner as in Example 3. The comparative developer No. 3 was subjected to the same 100,000-copy test as in Example 1. The results were that the image quality decreased during the copy test and the thickness of the silicone layer of the comparative carrier particles decreased as shown by curve B in FIG. 3.

EXAMPLE 4

The following components were dispersed in a homomixer for 10 minutes to prepare a silicone resin coating liquid:

| | Parts by Weight |
|---|---|
| Silicone Resin SR2406 made by Toray Silicone Co., Ltd. (containing 20 wt. % of silicone resin solids) | 0.4 Kg |
| Ligroin | 0.4 Kg |
| Potassium titanate (with an average particle size of 0.1 μm) | 5 g |
| Toluene | 800 g |

The thus prepared silicone resin coating liquid was coated on the surface of iron oxide particles with an average particle size of 70 μm, in an amount of 5 kg, in a fluidized bed type coating apparatus, whereby silicone resin-coated carrier particles No. 4 according to the present invention were obtained.

100 parts by weight of the carrier particles and 3.5 parts by weight of the toner particles prepared in Example 1 were mixed to prepare a two-component dry-type developer. The thus prepared two-component dry-type developer was subjected to the same copy test as in Example 1, in which 100,000 copies were made, as the toner particles were replenished when necessary, by use of the same copying machine, FT-6400, as that employed in Example 1.

Figure 4:
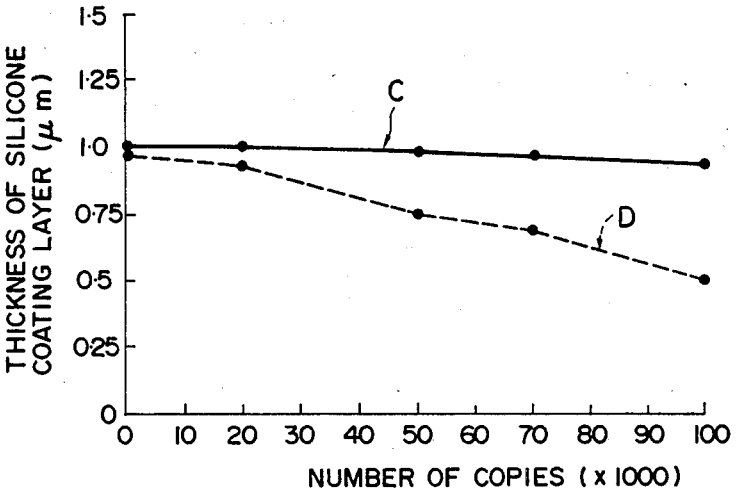
FIG. 4 is a graph showing the change in thickness of a silicone resin layer in an embodiment No. 4 of carrier particles according to the present invention and the change in thickness of a silicone resin layer coated on the surface of comparative carrier particles No. 4, during 100,000-copy tests by use of developers containing the respective carrier particles.

During this copying test, clear copies were invariably obtained. Further, during this copy test, the thickness of the silicone resin layer of the carrier particles was periodically measured, with the result that, as shown by curve C in FIG. 4, the thickness of the silicone resin layer substantially did not vary throughout the copy test.

Microscopic inspection of the carrier particles indicated that there were substantially no scratches in the silicone layer and no peeling of the silicone layer.

COMPARATIVE EXAMPLE 4

Example 4 was repeated except that potassium titanate was eliminated from the formulation of the silicone resin coating liquid, whereby comparative carrier particles were prepared. By use of the comparative carrier particles, a comparative developer No. 4 was prepared in the same manner as in Example 4. The comparative developer No. 4 was subjected to the same 100,000-copy test as in Example 1. The results were that the image quality decreased during the copy test and the thickness of the silicone layer of the comparative carrier particles decreased as shown by curve D in FIG. 4.

As can be seen from the above results, the silicone resin coating layer of the carrier particles according to the present invention is excellent in resistance to abrasion scratching and peeling off while in use. Therefore, the carrier particles according to the present invention, in combined use with commercially available toners, can provide developed images with high quality in a stable manner for a long period of time during use.

What is claimed is:

1. Carrier particles for use in a two-component dry-type developer for developing latent electrostatic images to visible images, comprising a core material and a silicone resin layer coated on the surface of said core material, said silicone resin layer comprising a silicone resin and, as a fortifying agent against abrasion of said carrier particles, inorganic fortifying filler particles selected from the group consisting of silicon carbide and potassium titanate.

2. Carrier particles as claimed in claim 1, wherein the amount of said inorganic fortifying filler particles is in the range of 5 wt.% to 50 wt.% of the total weight of said silicone resin layer, and the average particle size of said inorganic fortifying filler is in the range of 0.1 μm to 1.0 μm.

3. Carrier particles as claimed in claim 1, wherein said core material is selected from the group consisting of particles of sand, cobalt, iron, iron oxide, copper, nickel, zinc, aluminum, brass and glass, having an average particle size ranging from 20 μm to 1000 μm.

4. Carrier particles as claimed in claim 1, wherein said silicone resin is a room-temperature-setting type silicone resin of the formula

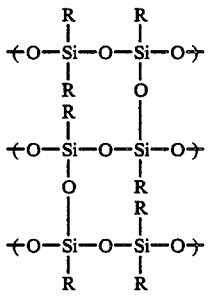

wherein R represents hydrogen, halogen, a hydroxy group, a methoxy group, a lower alkyl group with 1 to 4 carbon atoms, or a phenyl group.

5. A two-component developer for developing latent electrostatic images to visible images comprising toner particles and carrier particles coated with a silicone resin layer containing as a fortifying agent against abrasion inorganic fortifying filler particles selected from the group consisting of particles of silicon carbide and potassium titanate.

6. A two-component developer for developing latent electrostatic images to visible images comprising toner particles and carrier particles coated with a silicone resin layer containing as a fortifying agent against abrasion inorganic fortifying filler particles selected from the group consisting of particles of silicon carbide and potassium titanate, wherein said toner particles contain as a charge polarity control agent a monoazo metal complex dye of the following formula:

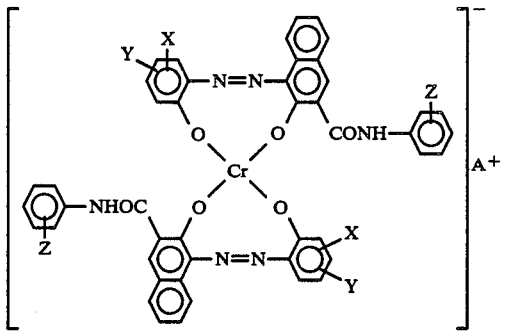

wherein X, Y and Z independently represent hydrogen, halogen, carboxyl, hydroxyl, nitro, sulfo or sulfonamide; and $A^+$ represents $H^+$, $K^+$, $Na^+$ or an aliphatic ammonium cation.

7. Carrier particles for use in a developer for developing electrostatic latent images, said carrier particles being adapted to carry toner particles on the surfaces of said carrier particles, comprising core particles having an average particle size in the range of 20 to 1000 μm selected from the group consisting of particles of sand, cobalt, iron, iron oxide, copper, nickel, zinc, aluminum, brass and glass, and a coating layer covering each of said core particles, said coating layer consisting essentially of a silicone resin containing dispersed therein filler particles of silicon carbide or potassium titanate, said coating layer having been prepared by coating said core particles with a liquid dispersion of said filler particles dispersed in a solvent solution of said silicone resin and then drying the coating, said filler particles being effective to prevent removal of said coating layer during use of said carrier particles.

8. Carrier particles as claimed in claim 7, wherein said silicone resin is a room-temperature-setting type silicone resin containing units of the formula

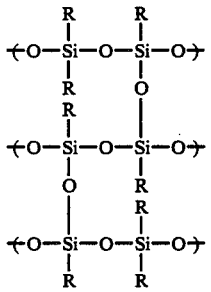

wherein R represents hydrogen, halogen, hydroxy, methoxy, lower alkyl having 1 to 4 carbon atoms, or phenyl.

9. Carrier particles as claimed in claim 8, wherein said core particles have an average particle size range in the range of 50 to 500 μm, and said coating layer is heated to a temperature in the range of 200° C. to 300° C. to harden said silicone resin.

10. A developer as claimed in claim 5, wherein said carrier particles consist essentially of core particles having an average particle size in the range of 20 to 1000 μm selected from particles of sand, cobalt, iron, iron oxide, copper, nickel, zinc, aluminum, brass and glass, and said silicone resin layer consists essentially of a silicone resin containing not more than 30 wt.% of unhardened silicone resin, and from 5 to 50 wt.%, based on the total weight of said coating layer, of said filler particles made of silicon carbide or potassium titanate, said filler particles having an average particle size in the range of 0.1 μm to 1.0 μm and wherein said toner particles are mixed with said carrier particles and cover 30% to 90% of the silicone-coated surface of said carrier particles.

11. A developer as claimed in claim 6, wherein said toner particles consist essentially of a resin, a coloring agent, and said monoazo metal complex dye.

12. A developer as claimed in claim 11, wherein said resin is polystyrene and said coloring agent is carbon black.

13. A developer as claimed in claim 10, wherein said toner particles have 0.2 to 2.0 wt.% of a surface lubricating polymer on the surfaces of said toner particles.

* * * * *